US010131063B2

(12) United States Patent
Metcalf et al.

(10) Patent No.: US 10,131,063 B2
(45) Date of Patent: Nov. 20, 2018

(54) ADAPTER FOR ATTACHING A RAZOR CARTRIDGE TO A RAZOR HANDLE

(71) Applicant: The Gillette Company, Boston, MA (US)

(72) Inventors: Stephen Cabot Metcalf, Newton, MA (US); Ashok Bakul Patel, Needham, MA (US)

(73) Assignee: The Gillette Company LLC, Boston, MA (US)

( * ) Notice: Subject to any disclaimer, the term of this patent is extended or adjusted under 35 U.S.C. 154(b) by 222 days.

(21) Appl. No.: 14/868,661

(22) Filed: Sep. 29, 2015

(65) Prior Publication Data

US 2017/0087732 A1 Mar. 30, 2017

(51) Int. Cl.
*B26B 21/52* (2006.01)
*B26B 21/14* (2006.01)
*B26B 21/22* (2006.01)

(52) U.S. Cl.
CPC ..... *B26B 21/521* (2013.01); *B26B 21/14* (2013.01); *B26B 21/225* (2013.01)

(58) Field of Classification Search
CPC ... B26B 21/4012; B26B 21/52; B26B 21/521; B26B 21/522; B26B 21/523; B26B 21/525; B26B 21/528; B25G 1/00; B25G 1/06; B25G 3/00; B25G 3/12
USPC ..... 30/32, 47–51, 526–536
See application file for complete search history.

(56) References Cited

U.S. PATENT DOCUMENTS 3,878,605 A * 4/1975 Braginetz ..... B25G 1/00 16/110.1
4,063,354 A * 12/1977 Oldroyd ..... B26B 21/4012 30/47
4,488,357 A * 12/1984 Jacobson ..... B26B 21/225 30/527
4,739,553 A 4/1988 Lazarchik
4,756,082 A * 7/1988 Apprille, Jr. ..... B26B 21/225 30/530
4,797,998 A * 1/1989 Motta ..... B26B 21/225 30/530
5,157,834 A * 10/1992 Chen ..... B26B 21/225 30/47
5,347,717 A * 9/1994 Ts'ai ..... B26B 21/225 30/50

(Continued)

FOREIGN PATENT DOCUMENTS

EP 0203527 12/1986

OTHER PUBLICATIONS

U.S. Appl. No. 14/868,674, filed Sep. 29, 2015, Stephen Cabot Metcalf.

*Primary Examiner* — Jason Daniel Prone
*Assistant Examiner* — Richard Crosby, Jr.
(74) *Attorney, Agent, or Firm* — Ronald T. Sia; Kevin C. Johnson

(57) ABSTRACT

A shaving razor adapter used to attach a shaving razor cartridge to a razor handle. The razor cartridge has a pair of distally positioned arc shaped receiving regions and a camming surface. The adapter engages the razor cartridge with a pair of outwardly facing arc shaped bearings for mating into said pair of arc shaped receiving regions of said razor cartridge. The adapter has a recess and a pair of detents for receiving and engaging the handle. The handle has a biasing member to engage the camming surface of said razor cartridge.

9 Claims, 4 Drawing Sheets

(56) References Cited

U.S. PATENT DOCUMENTS 5,784,790 A * 7/1998 Carson, III ..... B26B 21/225 30/532
5,787,586 A 8/1998 Apprille, Jr. et al.
5,813,293 A 9/1998 Apprille, Jr. et al.
5,918,369 A 7/1999 Apprille, Jr. et al.
5,956,851 A 9/1999 Apprille, Jr. et al.
6,122,826 A 9/2000 Coffin et al.
D445,958 S * 7/2001 Dansreau ..... B26B 21/522 D28/48
6,434,839 B1 * 8/2002 Lee ..... B26B 21/225 30/527
7,168,173 B2 1/2007 Worrick, III
7,200,942 B2 4/2007 Richard
7,331,107 B2 * 2/2008 Folio ..... B26B 21/225 30/50
7,461,458 B2 * 12/2008 Peyser ..... B26B 21/225 30/50
7,574,809 B2 * 8/2009 Folio ..... B26B 21/225 30/50
7,685,720 B2 * 3/2010 Efthimiadis ..... B26B 21/225 30/527
7,703,361 B2 4/2010 Johnson et al.
8,033,023 B2 * 10/2011 Johnson ..... B26B 21/225 30/50
8,286,354 B2 * 10/2012 Walker, Jr. ..... B26B 21/225 30/32
8,347,509 B2 * 1/2013 Votolato ..... B25F 1/003 30/151
8,474,144 B2 * 7/2013 Royle ..... B26B 21/521 30/527
8,615,891 B2 * 12/2013 Psimadas ..... B26B 21/222 30/526
8,671,577 B2 * 3/2014 Brown ..... B26B 21/225 30/50
8,732,965 B2 5/2014 Efthimiadis et al.
8,745,882 B2 * 6/2014 Murgida ..... B26B 21/521 30/527
8,745,883 B2 * 6/2014 Murgida ..... B26B 21/521 30/527
8,793,880 B2 * 8/2014 Taub ..... B26B 21/40 30/32
D714,492 S * 9/2014 Cataudella ..... D28/48
8,844,145 B2 * 9/2014 Psimadas ..... B26B 21/225 30/34.1
8,938,885 B2 * 1/2015 Stevens ..... B26B 21/52 30/50
9,469,038 B2 10/2016 Iaccarino et al.
9,550,303 B2 * 1/2017 Robertson ..... B26B 21/521
9,623,575 B2 * 4/2017 Griffin ..... B26B 21/521
9,701,034 B2 * 7/2017 Papadopoulos-Papageorgis ..... B26B 21/521
9,764,487 B2 * 9/2017 Robertson ..... B26B 21/521
2004/0181953 A1 * 9/2004 Folio ..... B26B 21/225 30/527
2005/0040661 A1 * 2/2005 Hsu ..... B25B 1/205 294/119.2
2008/0034589 A1 2/2008 Nearing
2009/0119924 A1 * 5/2009 Bozikis ..... B26B 21/38 30/45
2011/0067245 A1 3/2011 Bridges et al.
2011/0088269 A1 * 4/2011 Walker, Jr. ..... B26B 21/225 30/527
2014/0230258 A1 * 8/2014 Eagleton ..... B26B 21/522 30/527
2014/0259679 A1 * 9/2014 Tracy ..... B26B 21/225 30/50
2015/0190936 A1 * 7/2015 Griffin ..... B26B 21/225 132/200
2015/0321366 A1 * 11/2015 Papadopoulos-Papageorgis ..... B26B 21/222 30/532
2016/0101531 A1 * 4/2016 Bunnell ..... B26B 21/521 30/526
2016/0250764 A1 * 9/2016 Hashimoto ..... B26B 21/225 30/47
2016/0288349 A1 * 10/2016 Barrett ..... B26B 21/16
2016/0325445 A1 11/2016 Molinari
2017/0087732 A1 * 3/2017 Metcalf ..... B26B 21/14
2017/0087733 A1 * 3/2017 Metcalf ..... B26B 21/14

* cited by examiner

ADAPTER FOR ATTACHING A RAZOR CARTRIDGE TO A RAZOR HANDLE

FIELD OF THE INVENTION

The present invention relates to shaving razors and particularly to a shaving razor adapter for attaching a replaceable shaving razor cartridge to a shaving razor handle. More particularly, the present invention relates to an adapter suitable for attaching a shaving razor cartridge of a first shaving razor configuration to a shaving razor handle of a second shaving razor configuration. The second shaving razor configuration is different than the first shaving razor configuration.

BACKGROUND OF THE INVENTION

The shaving razor category has many different razor configurations, including razors that are "system" razors which have long lasting handles with replaceable cartridges, and disposable razors where the handle and cartridge are used together and thrown out after a time. Razors vary based on many attributes such as number of blades, cartridge shape, chemistry features on the cartridge and so forth. Razors are also manufactured by many different companies with different technology platforms.

Many system razors have their own docking interface between the handle and cartridge. The use of different docking systems is known, for example, Mach 3 and many Gillette Venus razor systems leverage a single point docking system. The Gillette Sensor and Sensor for Women razors have a different docking system with two attachment features that provide the dual function of attaching the cartridge and providing the arc about which the cartridge can pivot. These and other docking systems have been described. See U.S. Pat. Nos. 5,813,293; 5,787,586; 5,918,369; 4,739,553; and 4,756,082, U.S. Design Pat. D714492; and U.S. Patent Application No. 2011/0067245.

Many reasons exist for why new docking interfaces exist, such as upgrades to technology, easy of attaching/removing the cartridge, and so forth. Some razors even include fixedly attached structures on the razors that attach to the handle. These structures are sometimes referred to as the interconnect feature. See U.S. Pat. Nos. 7,168,173, 7,703,361, and 8,033,023. These interconnect structures, however, are provided with each and every cartridge in a fixed arrangement, and disposed of with the cartridge after use. For example, U.S. Pat. No. 7,703,361, which is similar to the Gillette Venus Breeze razor, the cartridge includes the interconnect feature which is not designed for removal from the cartridge housing. The opposing retaining features are attached to receiving regions in the back of the cartridge housing and absent a considerable amount of force, they cannot easily be detached.

Recently the use of adapters has been discussed to allow Fusion type razors to attach with Mach 3 type replaceable cartridges. See U.S. Pat. No. 8,793,880. Despite these advances, there remains a need to provide users with even more flexibility when they select replacement cartridges for their existing system handles.

SUMMARY OF THE INVENTION

In one aspect, the invention features relates to a shaving razor comprising: a razor cartridge, said razor cartridge comprising a housing forming a front surface and a rear surface opposite said front surface, said rear surface comprising a pair of distally positioned arc shaped receiving regions and a camming surface; an adapter having a front engagement surface and a rear engagement surface opposite said front engagement surface, said front engagement surface comprising a pair of outwardly facing arc shaped bearings for mating into said pair of arc shaped receiving regions of said razor cartridge, said rear engagement surface forming a recess and a retaining member protruding radially inward; and a handle, said handle comprising a distal end and a proximal end, said proximal end being shaped to engage with said recess, preferably the engagement between the handle and the adapter is a fixed engagement which once applied to the handle is not readily removable by a user. Preferably said pair of outwardly facing arc shaped bearings are retractable towards one another by any structure that allows a user to easily retract said bearings to allow a razor cartridge to be attached and detached.

A method of attaching a detachable razor cartridge to a handle comprising the steps of: providing a razor cartridge, said razor cartridge comprising a housing forming a front surface and a rear surface opposite said front surface, said rear surface comprising a pair of distally positioned arc shaped receiving regions and a camming surface; providing an adapter having a front engagement surface and a rear engagement surface opposite said front engagement surface, said front engagement surface comprising a pair of outwardly facing arc shaped bearings for mating into said pair of arc shaped receiving regions of said razor cartridge, and said rear engagement surface forming a recess and a retaining member protruding radially inward; and obtaining a handle, said handle comprising a distal end and a proximal end, said proximal end shaped to mate with said recess; fixedly attaching the rear side of said adapter to the proximal end of said handle, and optionally removably attaching the front side of said adapter to the rear surface of said razor cartridge.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1A:
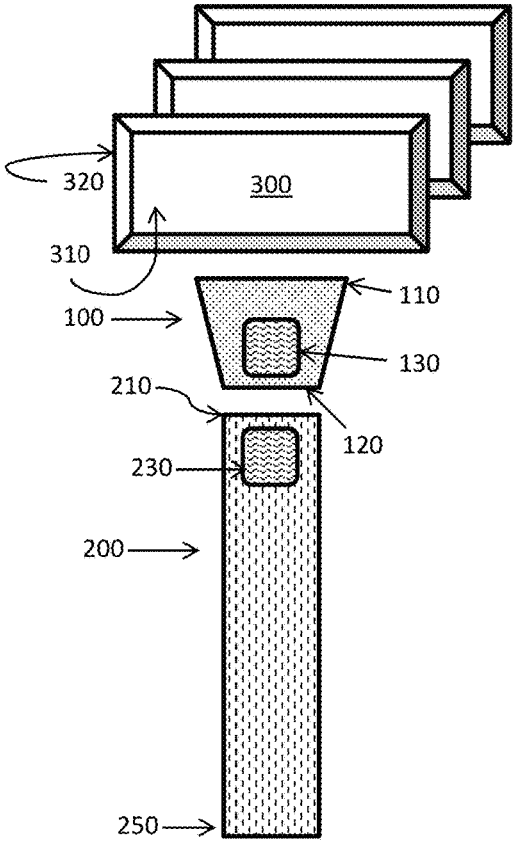
FIG. 1*a* is a planar view of a plurality of replaceable razor cartridges, an adapter and a handle, each in an unattached orientation.

The shaving razor adapter according to the present invention will be described with reference to the following figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

1. SHAVING RAZOR

One embodiment of the present invention provides for a shaving razor comprising: a removable and disposable razor cartridge, said razor cartridge comprising a housing forming a front surface and a rear surface opposite said front surface, said rear surface comprising a pair of arc shaped receiving regions positioned distally away from one another, and a camming surface; an adapter having a front engagement surface and a rear engagement surface opposite said front engagement surface, wherein said front engagement surface comprises a pair of outwardly facing arc shaped bearings for mating into said pair of arc shaped receiving regions of said razor cartridge.

a. Rear Engagement Surface of the Adapter:

In one embodiment, the rear engagement surface of the adapter forms a recess, a portion of the adapter forms a wall, from said wall extends a retaining member protruding radially inward into said recess (similar retaining members can be referred to as detents), such as two detents protruding into said recess. The recess is designed to receive a razor handle having a distal end and a proximal end; the distal end being positioned away from the adapter and the proximal end comprising a protruding member shaped to mate with said recess.

Where the adapter is designed to fixedly engage said handle, the retaining member(s) engage with correspondingly shaped receiving region(s) formed on said protruding member of the handle such that the adapter is attached to said handle. In one embodiment, the adapter can be removed from the proximal end of the handle if sufficient separating force is applied to pull the protruding member out of the recess—which would require that any retaining member(s) be shifted out of the receiving region(s) which act as anchors to retain the protruding member in the recess. This can be achieved with a push button mechanism that pushes against a fixed portion of the adapter so the protruding member is forced out of the recess such that the retaining member(s) are cleared of the receiving region(s). An example of this type of engagement system is used on Mach 3 refillable razors by Gillette as well as in many Gillette Venus refillable razors, and is also similarly described in U.S. Pat. No. 5,787,586—described as detents formed on the cartridge which engages with depressions on the handle. One key difference is that those detent/receiving region pairings are positioned on the cartridge/interconnecting member (which is fixedly attached to the cartridge) and the handle vs. via an adapter that can be fixedly attached to the handle itself while being easily removed from a cartridge. Those of skill in the art will appreciate that the retaining members and receiving regions can be swapped so the retaining member could be on the handle extending outwardly into receiving regions formed in the wall of the adapter.

In one embodiment, the portion of the adapter that forms the recess which forms the retaining member(s) and/or receiving region(s) is flexible to allow the proximal end of the handle to be pulled out of the recess. One way to do this would be to let the wall flap or move in and out slightly so the detents can evacuate the receiving regions with less force required. This can be useful for situations where a manufacturer wants a removable adapter.

In another embodiment, the portion of the adapter forming the retaining member(s) and/or receiving region(s) is not flexible and does not readily move. In this embodiment, once the protruding member is inserted into the recess and engagement is made, the user would not replace the adapter. In such a situation, the adapter is fixedly attached to the handle and made so that the handle no fits a different type of razor cartridge from what it was originally designed for. Those of skill in the art will appreciate that other ways to fixedly and/or removably attach the handle to the adapter are possible. For example, a sufficiently tight snap fit can be used so the adapter cannot easily be removed without damaging a portion of the device.

In one embodiment, the adapter comprises one or more detents extending from the adapter wall into said recess and the proximal end of said handle comprises a mating feature, such that when the proximal end is inserted into the recess, the detent(s) engage with said mating feature to secure said adapter onto said handle. Where the detent can be moved to escape the mating feature, the adapter can be removable. In another embodiment, the detent and mating features are structured so the adapter cannot easily be removed by a user. This can be particularly useful where the user wants to permanently or semi-permanently affix an adapter onto the handle so the handle can now be used with different cartridges from its original design. The removable adapter can be useful where the user desires flexibility to use the adapter for different cartridges, but also use the original cartridges designed for use with the handle. A removable adapter can also be useful so one adapter can be used with multiple handles.

b. Front Engagement Surface of the Adapter:

Turning to the other end of the adapter where the cartridge would interface, in one embodiment, the front engagement surface of the adapter further comprises a biasing member designed to engage with said camming surface to bias the razor cartridge about a pivot axis. Different forms of biasing members are known which can be used for this purpose, including but not limited to: a spring biased plunger that has a cam follower surface that extends from said adapter and engages said camming surface, such as used on Mach 3 and Fusion type razors (the plunger extends from the docking region of the handle and engages the rear surface of the housing of the razor to bias the cartridge into an at rest position from where it can be deflected to push the plunger inward. Another type of biasing member is the flexible spring return which acts on said camming surface. This type of biasing member has been used on Venus Breeze type razors such as described in U.S. Pat. No. 7,703,361 (describing the flexible spring return 145). In one embodiment, said front engagement surface of said adapter further comprises a spring biased plunger that has a cam follower surface that extends from said adapter to be engagable with the camming surface of said razor cartridge.

In one embodiment, the adapter does not include a biasing member. In such an embodiment, a biasing member can be provided from the proximal end of the razor handle itself. The function of the biasing member can be achieved by leveraging the existing protruding member which extends outwards from the proximal end. In this embodiment, the adapter forms an aperture, when the proximal end of the handle is inserted into the recess formed in the adapter; the protruding member passes into and through the recess with a portion of the protruding member passing through the aperture in the adapter. The tip of the protruding member acts as a cam so that when it extends through the recess, through the aperture, it will engage the camming surface on cartridge.

In one embodiment the pair of outwardly facing arc shaped bearings on the front engagement surface of the adapter is retractable towards one another. Many different razor handles having similar arc shaped bearings have been described. See e.g. U.S. Pat. Nos. 4,739,553, 7,331,107 and U.S. Design patent D674545, including the Gillette Sensor razor. One key difference here is that this docking system would not be present on end of a razor handle but rather on the front engagement surface of the adapter, which can attach to a handle that does not carry this docking system. In one embodiment, the outward facing arc shaped bearings are moveable and can be deformed from an at rest position toward one another. Deformation of the bearings can be by applying finger pressure onto the outer sides of the adapter supporting the bearings; these outer sides can be referred to as pressure receiving regions. These regions can be colored or textured to help users recognize the ability to apply pressure on these regions. In one embodiment, the adapter comprises an actuator, such as a press button or a sliding actuator to retract each of said pair arc shaped bearings inwardly towards one another.

2. METHOD OF USE

The invention also provides for a method of attaching a detachable razor cartridge to a handle comprising the steps of: providing a razor cartridge, said razor cartridge comprising a housing forming a front surface and a rear surface opposite said front surface, said rear surface comprising a pair of distally positioned arc shaped receiving regions and a camming surface; providing an adapter having a front engagement surface and a rear engagement surface opposite said front engagement surface, said front engagement surface comprising a pair of outwardly facing arc shaped bearings for mating into said pair of arc shaped receiving regions of said razor cartridge, and said rear engagement surface forming a recess and a retaining member protruding radially inward; and obtaining a handle, said handle comprising a distal end and a proximal end, said proximal end shaped to mate with said recess; and attaching the front side of said adapter to the rear surface of said razor cartridge.

In one embodiment, the handle that is used with the adapter is a used handle which could have been obtained from an earlier purchase. In one embodiment, the handle can be provided along with the adapter and cartridge(s).

In another embodiment, said steps of providing a razor cartridge and providing said adapter are performed by obtaining a kit comprising said razor cartridge and said adapter.

3. KITS AND PRODUCT CONFIGURATIONS

In one embodiment, the adapter and cartridge(s) can be packaged with a handle. The handle can be one that is designed to engage with the rear engagement surface of the cartridge (having a pair of outward facing arc shaped bearings). In such an embodiment, the handle can engage with the rear surface of one or more cartridge, but would not be able to engage with any portion of the adapter. The handle can comprise a distal end and a proximal end, said proximal end having a pair of outwardly facing arc shaped bearings for mating into said pair of arc shaped receiving regions of said razor cartridge, and a spring biased plunger that has a cam follower surface that extends from said adapter and engaging said camming surface to bias said housing of said razor cartridges. An example of this type of handle can be a Gillette Sensor style handle.

In another embodiment, the invention includes a handle that is designed to engage with the rear engagement surface of the adapter while the rear surface of the cartridge engages with the front engagement surface of the adapter. In such an embodiment, the adapter is particularly useful as it allows the cartridges to be used with a handle that is otherwise not structured to engage directly with the cartridge. In one embodiment, said handle comprises a distal end and a proximal end, said proximal end having a protruding member shaped to mate with said recess, said protruding member comprising a groove shaped to fit with said tongue of the adapter. An example of one type of handle for this purpose can be the Mach 3 OR Venus designed handle.

Another embodiment of the present invention provides for a kit comprising: a detachable razor cartridge (preferably a plurality of razor cartridges), each cartridge comprising a housing forming a front surface and a rear surface opposite said front surface, said rear surface comprising a pair of distally positioned arc shaped receiving regions and a camming surface; and an adapter having a front engagement surface and a rear engagement surface opposite said front engagement surface, said front engagement surface comprising a pair of outwardly facing arc shaped bearings for mating into said pair of arc shaped receiving regions of said razor cartridge, and said rear engagement surface forming a recess and a retaining member protruding radially inward.

In one embodiment, the kit is configured such that the adapter is not attached to any of said razor cartridge(s) when in packaging.

In one embodiment, the kit is free of any razor handles. In such a configuration, the kit simply consists of the plurality of razor cartridges and the adapter(s). In many situations, there may be no need for more than one adapter to be included with the kit. Without intending to be bound by theory, it is believe this kit can be marketed to consumers who have a handle having an engagement system structured to engage with rear engagement surface of the adapter. At the same time, the same kit can be marketed to users who have a different handle, a handle that includes an engagement system structured to engage with the rear surface of the cartridge. In this way, the same cartridges can be marketed for use by users having either or both types of handles. In another embodiment, the kit comprises one or more handles.

In another embodiment, the invention provides for a method of attaching a detachable razor cartridge to a handle comprising the steps of: providing kit as described herein, obtaining a handle, said handle comprising a distal end and a proximal end, said proximal end designed to engage the recess of said adapter; attaching the rear surface of said adapter to the proximal end of said handle; and attaching the front side of said adapter to the rear surface of said razor cartridge.

4. DETAILED DISCRIPTION OF THE FIGURES

Figure 1B:
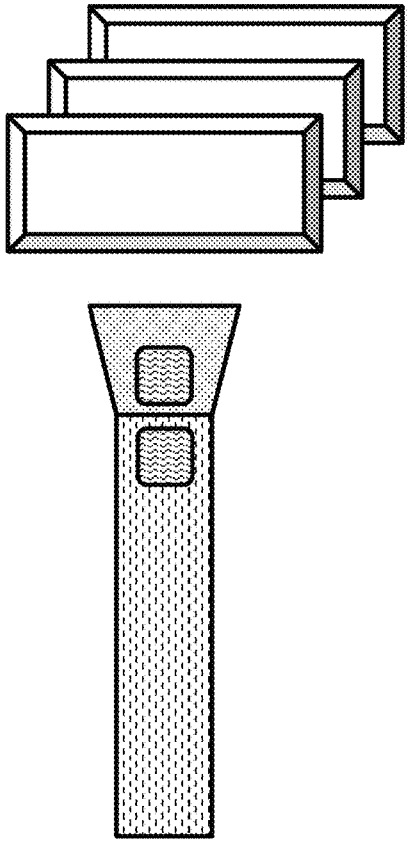
FIG. 1*b* is a planar view of the same objects in FIG. 1*a*, but with the adapter attached to the handle.

FIG. 1*a* is a planar view of a plurality of replaceable razor cartridges 300, said cartridges having front surface 320 and a rear 310, opposite said front surface. An adapter 100 is shown having a front engagement surface 110 and a rear engagement surface 120 opposite said front engagement surface. The adapter is shown with a button 130 for engaging and disengaging a pair of outwardly facing arc shaped bearings (shown in FIG. 2). Also shown is a handle 200 having a proximal end 210 and a distal end 250. The handle is shown with an actuator button 230 for releasing the handle from the adapter. FIG. 1*b* is a planar view of the same objects in FIG. 1*a*, but with the adapter attached to the handle.

Figure 2A:
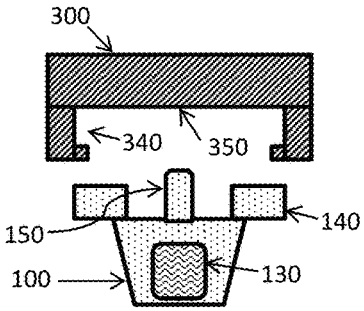
FIGS. 2*a*, 2*b* and 2*c* are three planar views of a razor cartridge and an adapter, where the adapter is deformed to attach to the razor cartridge.
Figure 2B:
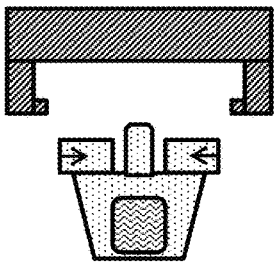
Figure 2C:
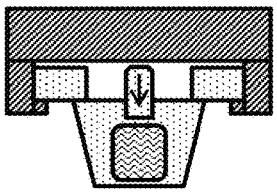

FIGS. 2*a*, 2*b* and 2*c* are three planar views of a razor cartridge 300 and an adapter 100, where the adapter comprises a pair of outwardly facing arc shaped bearings 140. The rear surface of the cartridge comprises a pair of distally positioned arc shaped receiving regions 340 and a camming surface 350. The arc shaped bearings can be moved towards one another to allow the adapter to engage with the cartridge. The adapter is shown with a biasing member 150 which moves in and out to apply pressure onto the camming surface to bias the razor cartridge into a resting position where the cartridge can be pivoted to an actuated position during use.

Figure 3A:
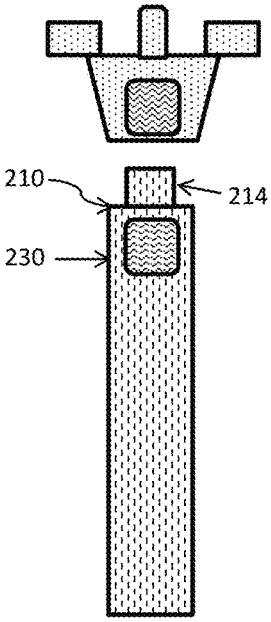
FIGS. 3*a*, 3*b* and 3*c* are three planar views of an adapter and a razor handle, where the adapter is attached to the razor handle.
Figure 3B:
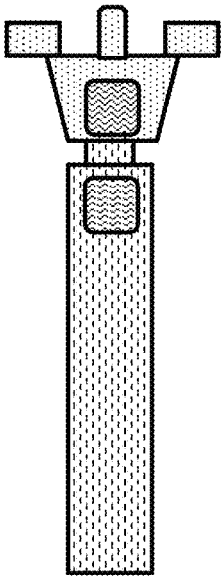
Figure 3C:
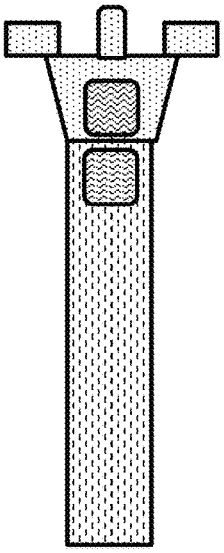
Figure 6A:
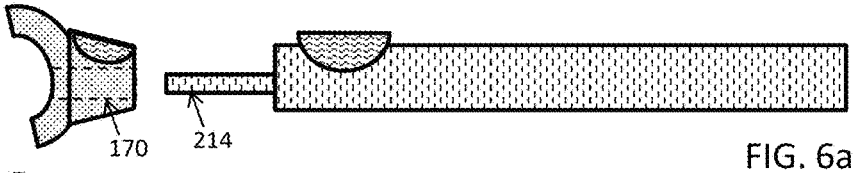
FIG. 6*a* is a side view of an adapter and a razor handle.
Figure 6B:
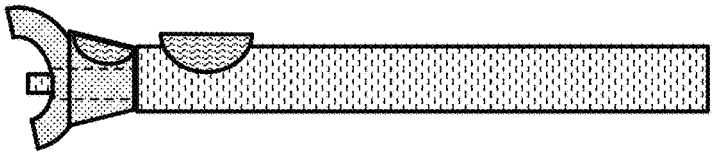
FIG. 6*b* is a side view of the adapter and razor handle of FIG. 6*a*, but in an attached configuration.

FIGS. 3*a*, 3*b* and 3*c* are three planar views of an adapter and a razor handle in different configurations. In 3*a*, the adapter and handle are detached with the handle comprising a proximal end 210 forming a protruding member 214 shaped to mate with a recess formed in the rear engagement surface of the adapter (shown in FIGS. 6*a* and 6*b* as element 170 that is adapted to receive the protruding member 214). FIGS. 3*b* and 3*c* show the handle being engaged into the adapter.

Figure 4A:
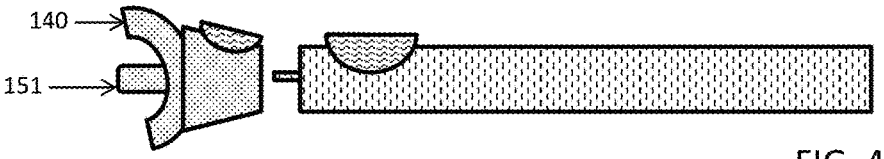
FIG. 4*a* is a side view of an adapter and a razor handle.
Figure 4B:
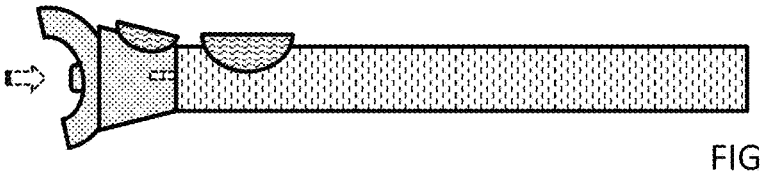
FIG. 4*b* is a side view of the adapter and razor handle of FIG. 4*a*, but in an attached configuration.
Figure 5A:
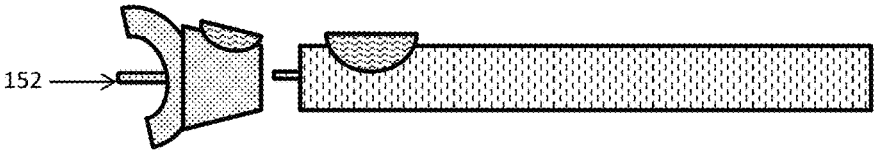
FIG. 5*a* is a side view of an adapter and a razor handle.
Figure 5B:
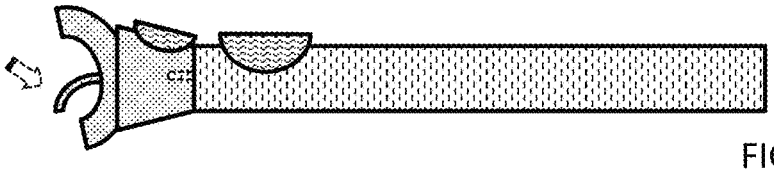
FIG. 5*b* is a side view of the adapter and razor handle of FIG. 5*a*, but in an attached configuration.

FIGS. 4*a* and 4*b* shows a side view the adapter comprises an arc shaped bearing 140, and biasing member 151 which is shown in an extended position in 4*a* and a retracted position in 4*b*. FIGS. 5*a* and 5*b* show a similar adapter and handle but with a flexible spring return 152 which can act on the camming surface of the razor cartridge.

Figure 7:
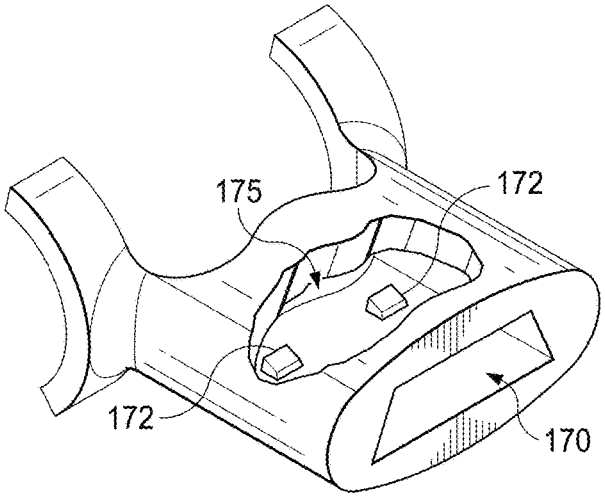
FIG. 7 is a perspective view of an adapter.
Figure 8:
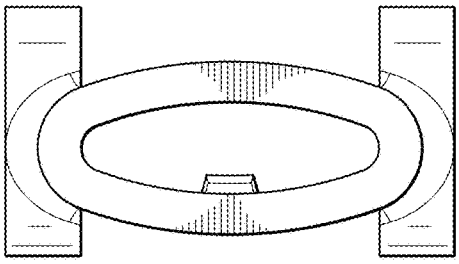
FIG. 8 is a frontal view of another adapter.

FIGS. 7 and 8 show two adapters with rear engagement surfaces forming a recess 170 and a retaining member(s) 172 protruding radially inward to engage retaining members that would be formed in the protruding member of the proximal end of the handle. FIG. 7 also shows detents 172 which are adapted to engage with receiving regions that would be formed in the protruding member of a razor handle. These detents are formed on a wall 175 which forms said recess. FIG. 8 is a frontal view of another adapter looking into the recess of the adapter.

Figure 9:
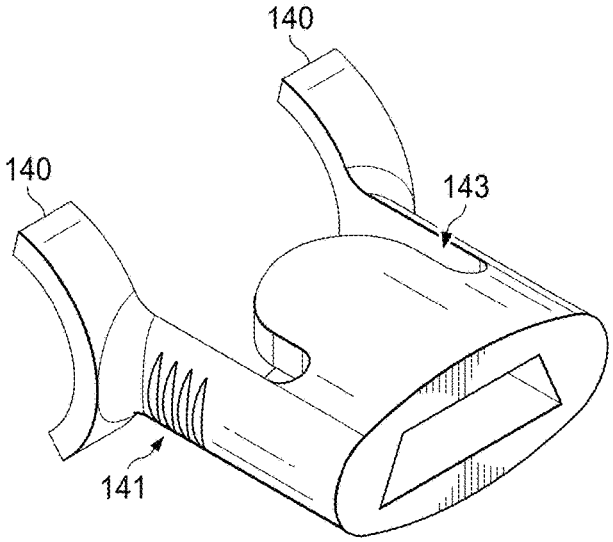
FIG. 9 is a perspective of yet another adapter.

FIG. 9 is a perspective of yet another adapter where the arc shaped bearings 140 are supported on bearing arms. The bearing arms are movable, in this embodiment, they can be pressed together when the user applies force to pressure receiving regions/surface 141 to move the bearing arm inward toward gap 143, thereby allowing the bearings to be retracted so the adapter can engage or disengage with a razor cartridge.

Materials for forming the adapter can be selected as desired. Preferably, the adapter 10 is formed of metal, such as a zinc alloy. The adapter can, however, be formed of other materials, including plastics (e.g., plated acrylonitrile-butadiene-styrene) and plastics with metal inserts. Any suitable method for forming the adapter can be employed including die casting, investment casting and molding. Suitable methods for forming include molding, such as injection molding.

The shaving razor adapter according to the present invention can be included as part of a shaving razor cartridge packaging kit. The shaving razor cartridge packaging kit comprises one or more disposable shaving razor cartridges of the first shaving razor configuration and the shaving razor adapter. The shaving razor adapter attaches the disposable shaving razor cartridge of the first shaving razor configuration to a shaving razor handle of a second shaving razor configuration. The one or more shaving razor cartridges and the shaving razor adapter are packaged in a common package.

For this embodiment, packaging including the shaving razor adapter and one or more shaving razor cartridges of the first shaving razor configuration can be distributed to consumers using the second shaving razor configuration as a promotion to get them to try the shaving razor cartridge of the first shaving razor configuration.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising:

a. a razor cartridge, said razor cartridge comprising a housing forming a front surface and a rear surface opposite said front surface, said rear surface comprising a pair of distally positioned arc shaped receiving regions and a camming surface;

b. an adapter having a front engagement surface and a rear engagement surface opposite said front engagement surface, i. said front engagement surface comprising a pair of outwardly facing arc shaped bearings for mating into said pair of arc shaped receiving regions of said razor cartridge, and ii. said rear engagement surface forming a recess and a pair of detents positioned on a wall formed from said adapter, said pair of detents protruding radially inward; and c. a handle, said handle comprising a distal end and a proximal end, said proximal end being shaped to removably engage said recess, said proximal end forming receiving regions to accept said pair of detents formed in said adapter wall, said proximal end comprising a spring biased plunger having a cam follower surface, d. wherein said front engagement surface of said adapter forms an aperture, and said cam follower surface extends through said aperture to engage the camming surface of said razor cartridge.

2. The razor of claim 1, wherein said rear surface of said housing is attached to said front engagement surface of said adapter.

3. The razor of claim 2, wherein said front side of said adapter is removably attached to said razor cartridge.

4. The razor of claim 1, wherein each of said pair of retractable arc shaped bearings comprises a pressure receiving region positioned on opposing sides of the adapter.

5. The razor of claim 1, wherein said adapter comprises an actuator to retract each of said pair arc shaped bearings inwardly towards one another.

6. The razor of claim 1, wherein said proximal end comprises a protruding member shaped to mate with the recess of the adapter.

7. The razor of claim 1, wherein said wall forming said pair of detents forms part of said recess of said adapter.

8. The razor of claim 7, wherein said pair of detents do retract.

9. The razor of claim 1, wherein said front engagement surface of said adapter further comprises a spring biased plunger that has a cam follower surface that extends from said adapter to be engageable with the camming surface of said razor cartridge.

* * * * *